US008163135B2

(12) United States Patent
Loippo

(10) Patent No.: US 8,163,135 B2
(45) Date of Patent: Apr. 24, 2012

(54) APPARATUS AND METHOD FOR PIVOTAL MOUNTING OF A DOCTOR BLADE ASSEMBLY IN A PAPER MACHINE

(75) Inventor: Kimmo Loippo, Jokihaara (FI)

(73) Assignee: Runtech Systems Oy, Kolho (FI)

( * ) Notice: Subject to any disclaimer, the term of this patent is extended or adjusted under 35 U.S.C. 154(b) by 171 days.

(21) Appl. No.: 12/749,818

(22) Filed: Mar. 30, 2010

(65) Prior Publication Data

US 2010/0243189 A1 Sep. 30, 2010

(30) Foreign Application Priority Data

Mar. 31, 2009 (FI) ..... 20090121

(51) Int. Cl.
*D21F 1/32* (2006.01)

(52) U.S. Cl. ..... 162/199; 162/272

(58) Field of Classification Search ..... 162/199, 162/272, 261
See application file for complete search history.

(56) References Cited

U.S. PATENT DOCUMENTS 5,980,692 A * 11/1999 Goodnow et al. ..... 162/281
6,312,563 B1 * 11/2001 Goodnow et al. ..... 162/281

FOREIGN PATENT DOCUMENTS

| | | |
|---|---|---|
| FI | 105577 B | 9/2000 |
| FI | 114328 B | 9/2004 |
| GB | 693187 A | 6/1953 |

* cited by examiner

*Primary Examiner* — Mark Halpern
(74) *Attorney, Agent, or Firm* — Birch, Stewart, Kolasch & Birch, LLP

(57) ABSTRACT

A paper machine doctor assembly includes a doctor blade and a blade holder holding the same and a support member mounted on the paper machine frame. An essential feature of the assembly is that a separate pivot mount is provided between the blade holder and the support member, the separate pivot mount enabling the blade holder and the pivot mount to be disconnected from the support member by pulling the pivot mount outwardly and away from the support member.

20 Claims, 3 Drawing Sheets

Figure 1:
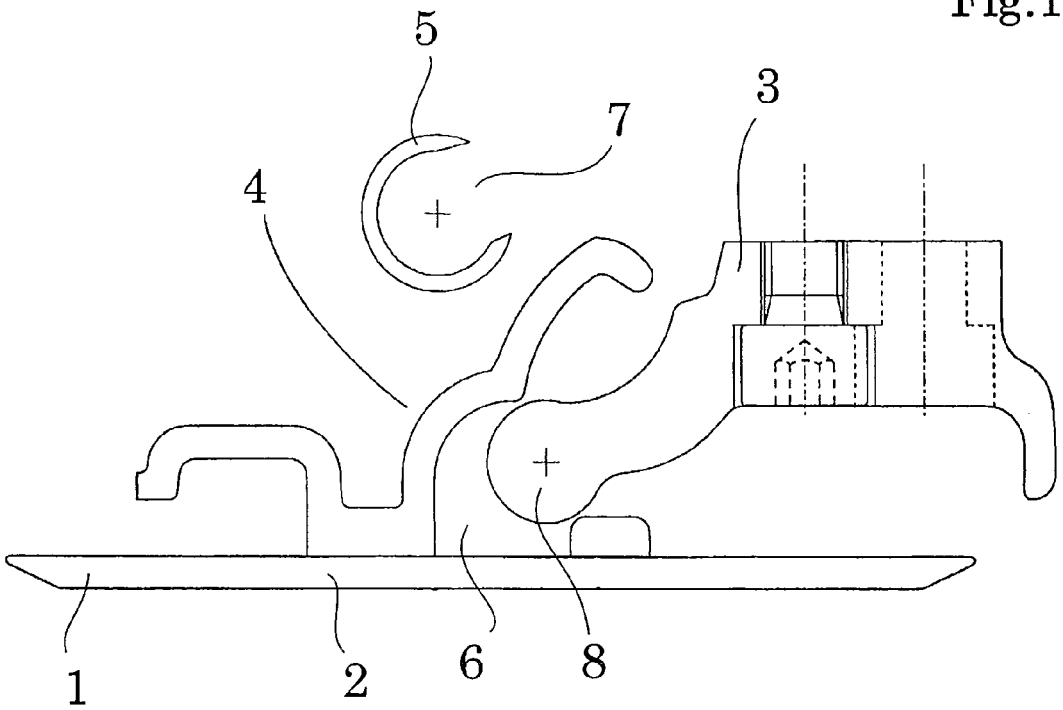
Figure 1:
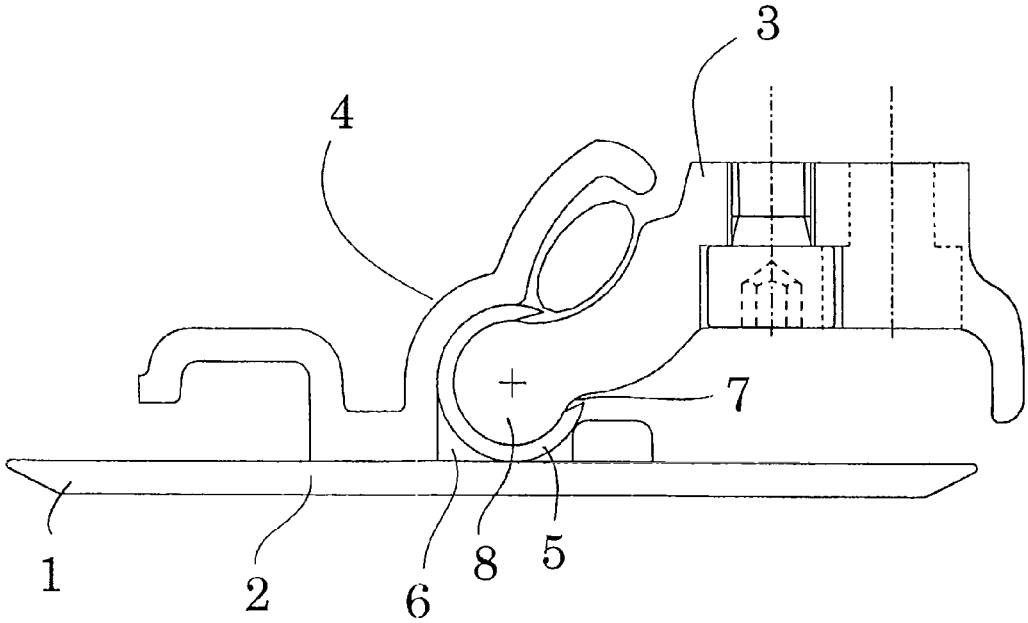

APPARATUS AND METHOD FOR PIVOTAL MOUNTING OF A DOCTOR BLADE ASSEMBLY IN A PAPER MACHINE

The invention relates in accordance with the preamble of claim 1 to a pivotal mounting in a doctor blade assembly. Furthermore, the invention relates to a method in accordance with claim 10.

In the prior art, arrangements are known aiming at simplification of the doctor blade assembly and its serviceability. Conventionally, these constructs have been hampered by their heavy weight and, resultingly, such a pivot mount construction whose serviceability has been compromised. This has often been an essential disadvantage inasmuch as machine serviceability particularly in paper industry is crucial with respect to efficiency of production. When problems arise in serviceability and removal of dirt, the consequences are seen as reduced efficiency of papermaking, lower quality of paper web and, possibly, as need for running the paper machine at a lower speed; all of these causing losses in production.

The state of the art is represented by, e.g., patent FI-105577 issued on a doctor blade assembly. This patent publication discloses a pivotal mounting implemented in such a manner that it comprises a precisely defined U-shaped mount having a fixed structure. Into this structure is adapted a support pin serving as a compatible member of the pivot mount. The support pin has a rounded side profile with a given mounting tolerance allowing it to fit into the U-shaped mount. The support pin is included as fixed and solid member of the paper machine frame thus supporting the doctor blade assembly on the paper machine frame.

It is an object of the present invention to provide an entirely novel approach to a pivotal mounting of a doctor blade in the fashion specified in the claims. The goal of the invention is to develop the pivotal mounting of the doctor blade so as to achieve a substantial improvement in the serviceability therefor. Simultaneously, a simpler construction thereof becomes feasible without compromising its functionality.

Due to its simplified construction, the embodiment according to the invention does not necessary need such a U-shaped mount construction as is used in prior art for pivotal doctor blade mounting. Moreover, the invention disposes with the need for a fixed pivot pin that can be replaced with a substantially simpler structure comprising a shaft or tubular member having a groove, beveled depression or the like slot such that the member becomes almost C-shaped or similarly shaped.

As mentioned above, the embodiment according to the invention does not necessarily need a precisely dimensioned U-shaped structure of the tubular member. The concept of the invention is sufficiently accomplished by way of making the tubular member, e.g., by bending/combining or otherwise shaping one or more blanks in such a fashion that the tubular member can move within the tolerances required by a pivotal mount.

Respectively, the C-shaped slot of the tubular member is dimensioned such that the compatible support member rigidly fixed to the paper machine frame is advantageously clamped into the slot of the tubular member, more precisely, into the clevis-type jaws formed by the upper and lower faces of the slot. Having the support member fixed to the paper machine frame inserted into the jaws formed by the slot of the tubular member, it thus becomes integrated into the pivot mount in a sealed, yet easily dismountable manner. During a maintenance operation, the tubular member is simply pulled out in a perpendicular direction to the pivot mount shaft and, conversely, in reassembly it slides accurately onto the frame-mounted support member that fixes the tubular member to the paper machine frame. Resultingly, maintenance is simplified and securing the pivot mount disposes with the need for screws or other additional fixing elements.

Since the tubular member is not fixed to the frame structure of the machine by any screws or other additional elements, but rather, the tubular member is compressively fixed in place, this arrangement allows that also the frame-mounted support member can be provided with slots, depressions or the like faces that are compatible with the slot of the C-shaped tubular member.

An essential feature of the invention is that the tubular member functions as a self-contained structure thus allowing it to be separately pulled out from the frame structure portion supporting the doctor blade assembly on the paper machine frame. Resultingly, the tubular member can be first pulled out followed by the removal of the doctor blade from paper machine frame, whereby the mounting/dismantling of the pivot mount for maintenance is substantially simplified with regard to the procedures of the prior art.

The shape and size of the slot in the tubular member are chosen on a case by case basis, and, moreover, the tubular member can be made from a selection of different materials such as metal, fiber-reinforced composite, polymer or any combination of like materials.

In accordance with the above description, the invention is based on a novel construction of a pivot mount of a doctor blade assembly with a special emphasis on the serviceability of the doctor blade assembly. The embodiment according to the invention offers plural significant benefits.

More precisely, the invention is characterized by what is disclosed in the appended claims.

Figure 2:
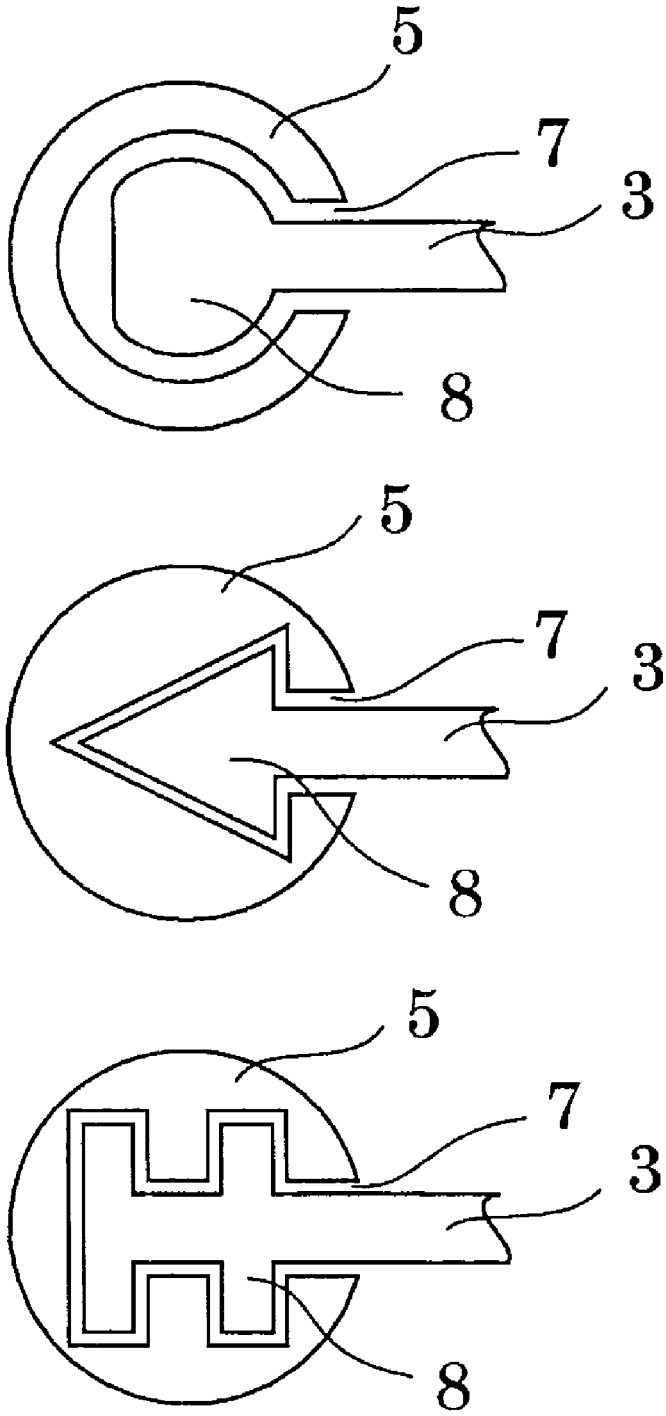
Figure 3:
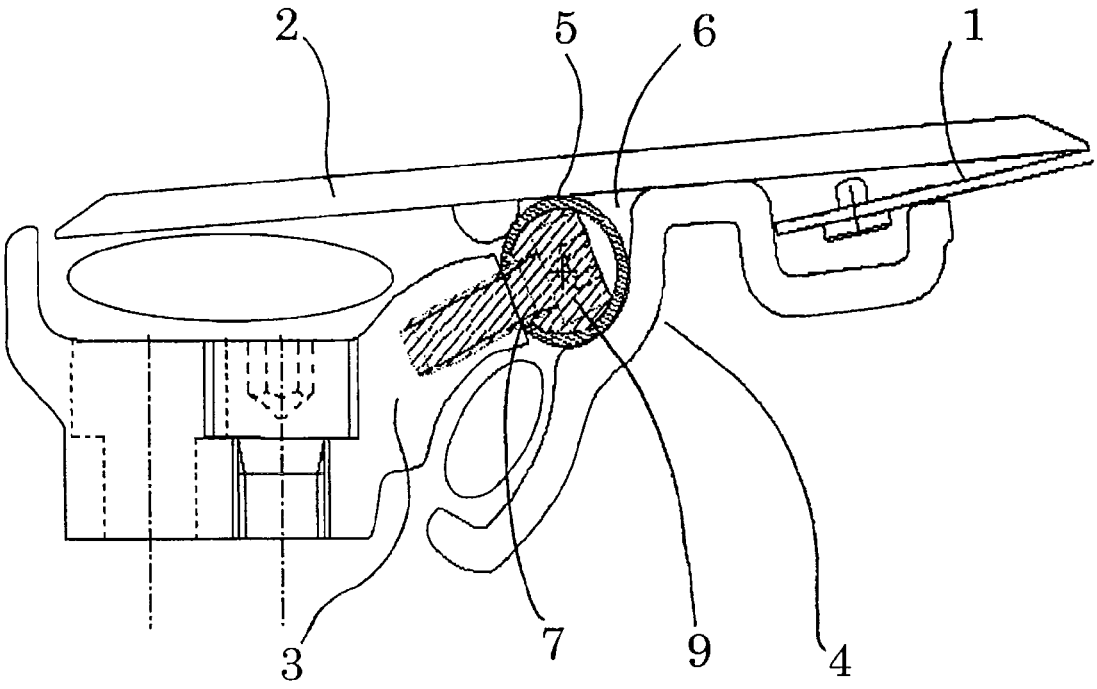

The invention is next described by making reference to the annexed drawings wherein FIG. 1 shows the principal elements of the pivot mount of a doctor blade assembly;

FIG. 2 shows the principal features of the detachable shaft of the pivot mount; and FIG. 3 shows the principal elements of an exemplary embodiment of the pivot mount.

As shown in FIG. 1 the doctor blade assembly of a paper machine comprises a blade holder 2 holding the doctor blade 1 and a support member 3 mounted on the paper machine frame. Connecting the blade holder 2 and the member 3 is provided a separate pivot mount 4 cooperating with the blade holder 2 and the member 3 thereof so that it can be dismantled by pulling it outwardly.

In the embodiment according to the invention, the pivot mount 4 most advantageously comprises a shaft, bar, bushing or like tubular member 5 having its one wall point machined open to include a groove, beveled depression or the like slot. Accordingly, as described for a exemplary embodiment, tubular member 5 acting as the pivot mount 4 is most advantageously hollow with a substantially C-shaped cross section.

The tubular member 5 of the pivot mount 4 is adapted into a cavity 6 formed in the blade holder 2 so that its axis is substantially parallel to the blade 1. The cavity 6 is most advantageously formed into the holder 2 from a continuous section so that its bent shape of one or plural portions forms a cavity capable of accommodating the tubular member 5.

Respectively, the end 8 of the member 3 mounted on the paper machine frame is inserted into the slot 7 of the C-shaped tubular member 5. In this fashion the member 3 becomes an integral part of the paper machine frame permitting the doctor blade assembly to supported by the separate pivot mount 4 to the paper machine frame.

With reference to FIG. 1, it is essential to have the slot 7 of the C-shaped tubular member 5 of pivot mount 4 dimensioned so that the end 8 of the support member 3 becomes seated in the slot 7 of tubular member 5. The support member is most advantageously clamped in the jaws formed between the upper and lower faces of the slot. If a more secure clamping is desired, the frame-mounted member 3 can be provided with grooves, depressions or the like beveled faces that are compatible with the slot made in the C-shaped tubular member 5.

Hence, the shape of the end 8 of the frame-mounted member 3 can be varied widely. One advantageous shape is such that the end 8 has an essentially round or possibly ellipsoidal cross section that fits into the substantially round bore of the tubular member 5 acting as the mating member. As shown in FIG. 2, the cross-sectional shape of the end 8 can as well be multifaceted, e.g., with a triangular, square or multiangular shape. Herein it is essential to give the inner cross section of the tubular member 5 of the mating part an essentially compatible shape to secure the mating of the end 8 with the inner cross section of the tubular member, i.e., to achieve a kind of male-female joint.

In addition to that discussed above, it is possible the cross section of the end 8 of the member 3 is substantially flat, possibly having grooves made thereon. The number of groove may by one or more with a shape mating with the slot 7 of the tubular member 5. In this fashion the slot 7 may be shaped in plural different ways, e.g., such that its cross section is essentially toothed or dove-tail shaped. Thus, in accordance with the invention, the shape of the end 8 and the slot 7 of the tubular member 5 can be varied as desired. The essential requirement is that the outer face of the tubular member 5 is adapted to fit essentially into the cavity 6 and, respectively, the inner face of the tubular member 5 to fit on the end 8.

As shown in FIG. 3, the end 8 of the member 3 may alternatively be replaced by separate inserts 9 designed to fit into the slot 7 of the tubular member 5. In this alternative, the pivot mount is implemented so that the tubular member 5 slides onto the irregularly shaped inserts 9 thus forming a pivot point. Most advantageously these inserts 9 are elements, such as screws attached to member 3, shaped compatible with interior shape of the tubular member 5. The number of screws is selected on a case by case basis, however, at least two screws are needed but more advantageously a greater number of screws is used advantageously placed equidistantly to support the tubular member 5.

In addition to the above-described assembly, the invention is directed to a method for improving the serviceability of the doctor blade assembly of a papermaking machine. The method utilizes a doctor blade 1 mounted in a blade holder 2 and a member 3 mounted on the paper machine frame. The essential feature of the method is that between the blade holder 2 and the member 3 is constructed a separate pivot mount 4 adapted on the member 3 so that it can detached therefrom by pulling.

A further feature of the method is that the tubular member 5 of the pivot mount 4 is adapted into a cavity 6 formed in the blade holder 2 so that its axis is substantially parallel to the blade 1. The end 8 of the member 3 mounted on the paper machine frame is inserted into the slot 7 of the C-shaped tubular element 5. Respectively, the end 8 of the member 3 mounted on the paper machine frame is inserted into the slot 7 of the C-shaped tubular member 5, whereupon the member 3 becomes an integral part of the paper machine frame permitting the doctor blade assembly to supported by the separate pivot mount 4 to the paper machine frame.

To a person skilled in the art it is obvious that the invention is not limited by the above-described exemplary embodiments, but rather may be varied within the inventive spirit and scope of the appended claims.

What is claimed is:

1. A paper machine doctor assembly comprising:

a doctor blade, a blade holder holding the doctor blade, a support member mounted on a paper machine frame, and a separate pivot mount for connecting the blade holder and the support member to each other, wherein the pivot mount is fixed to the blade holder and is separable from the support member by pulling the support member away from the pivot mount and the blade holder, which are fixed to each other.

2. The doctor assembly of claim 1, wherein the pivot mount comprises a shaft, bar, bushing, or a tubular member having one wall point machined open to include a groove, a beveled depression, or a slot.

3. The doctor assembly of claim 2, wherein the tubular member (5) acting as the pivot mount (4) is most advantageously hollow with a substantially C-shaped cross section.

4. The doctor assembly of claim 2, wherein a C-shaped tubular member of the pivot mount is insertable into a cavity formed adjacent to an upper surface of the blade holder so that an axis of the tubular member is substantially parallel to the doctor blade, and that an end of the support member mounted on the paper machine frame is inserted into a slot of the C-shaped tubular member, whereupon the support member becomes an integral part of the paper machine frame permitting the doctor blade assembly to supported on the paper machine frame by the separate pivot mount.

5. The doctor assembly of claim 2, wherein a slot of a C-shaped tubular member of the pivot mount is dimensioned so that an end of the support member mounted on the paper machine frame becomes seated in the slot of the tubular member and is clamped in jaws formed between upper and lower faces of the slot.

6. The doctor assembly of claim 1, wherein a tubular member acts as the pivot mount and is hollow with a substantially C-shaped cross section.

7. The doctor assembly of claim 6, wherein a C-shaped tubular member of the pivot mount is insertable into a cavity formed adjacent to an upper surface of the blade holder so that an axis of the tubular member is substantially parallel to the doctor blade, and that an end of the support member mounted on the paper machine frame is inserted into a slot of the C-shaped tubular member, whereupon the support member becomes an integral part of the paper machine frame permitting the doctor blade assembly to supported on the paper machine frame by the separate pivot mount.

8. The doctor assembly of claim 6, wherein a slot of a C-shaped tubular member of the pivot mount is dimensioned so that an end of the support member mounted on the paper machine frame becomes seated in the slot of the tubular member and is clamped in jaws formed between upper and lower faces of the slot.

9. The doctor assembly of claim 1, wherein a C-shaped tubular member of the pivot mount is insertable into a cavity formed adjacent to an upper surface of the blade holder so that an axis of the tubular member is substantially parallel to the doctor blade, and that an end of the support member mounted on the paper machine frame is inserted into a slot of the C-shaped tubular member, whereupon the support member becomes an integral part of the paper machine frame permitting the doctor blade assembly to be supported on the paper machine frame by the separate pivot mount.

10. The doctor assembly of claim 9, wherein a slot of a C-shaped tubular member of the pivot mount is dimensioned so that an end of the support member mounted on the paper machine frame becomes seated in the slot of the tubular member and is clamped in jaws formed between upper and lower faces of the slot.

11. The doctor assembly of claim 1, wherein a slot of a C-shaped tubular member of the pivot mount is dimensioned so that an end of the support member mounted on the paper machine frame becomes seated in the slot of the tubular member and is clamped in jaws formed between upper and lower faces of the slot.

12. The doctor assembly of claim 1, wherein an end of the support member is provided with grooves, depressions, or beveled surfaces designed to fit into a slot of the tubular member, or alternatively, the end is replaced by separate inserts.

13. The doctor assembly of claim 1, wherein a tubular member of the pivot mount is fabricated from a shaft, bar, bushing or blank made from a selection of different materials including: a metal, a fiber-reinforced composite, a polymer or any combination thereof.

14. The doctor assembly of claim 1, wherein a cross-sectional shape of an end of the support member is essentially round, ellipsoidal or, alternatively, triangular, square, multi-angular, or essentially flat, whereby a surface of the end is provided with grooves serving to clamp the end in a slot of a tubular member of the pivot mount.

15. The doctor assembly of claim 1, wherein a cross-section of the blade holder of the doctor blade is implemented by bending one or more sheet blanks so as form a cavity of the pivot mount for accommodating a tubular member.

16. A method for improving the serviceability of a paper machine doctor assembly comprising:

a doctor blade, a blade holder holding the doctor blade, a support member mounted on the paper machine frame, a separate pivot mount for connecting the blade holder and the support member to each other, and wherein the method comprises:

fixing the separate pivot mount to the blade holder, and separating the pivot mount from the support member by pulling the support member away from the pivot mount, thereby separating the support member from the separate pivot plate and the blade holder, which are fixed to each other.

17. The method of claim 16, wherein the method further comprises:

inserting a C-shaped tubular member of the pivot mount into a cavity formed in the blade holder an axis of the tubular member is substantially parallel to the doctor blade and that an end of the support member mounted on the paper machine frame is inserted into a slot C shaped tubular member, whereupon the support member becomes an integral part of the paper machine frame permitting the doctor blade assembly to be supported by the separate pivot mount on the paper machine frame.

18. The method of claim 16, wherein the method further comprises:

dimensioning a slot of a C-shaped tubular member of the pivot mount so that an end of the support member mounted on the paper machine frame becomes seated in the slot of the tubular member, and is clamped in jaws formed between the upper and lower faces of the slot.

19. The method of claim 16, wherein the method further comprises:

dismantling the paper machine doctor assembly by pulling out a tubular member orthogonally to a main axis of the pivot mount and reassembling the paper machine doctor assembly by sliding the tubular member onto the support member, thus securing the paper machine doctor assembly to the paper machine frame.

20. The method of claim 16, wherein the support member has an end with a cross-sectional shape which is essentially round, ellipsoidal or, alternatively, triangular, square, or multi-angular, or essentially flat, whereby a surface of the end is provided with grooves serving to clamp the end in a slot of the tubular member.

* * * * *